US009196950B1

(12) United States Patent
Leiba

(10) Patent No.: US 9,196,950 B1
(45) Date of Patent: Nov. 24, 2015

(54) SYSTEMS AND METHODS FOR VIBRATION AMELIORATION IN A MILLIMETER-WAVE COMMUNICATION NETWORK

(71) Applicant: Siklu Communication Ltd., Petach-Tikva (IL)

(72) Inventor: Yigal Leiba, Holon (IL)

(73) Assignee: Siklu Communication Ltd., Petach-Tikva (IL)

( * ) Notice: Subject to any disclaimer, the term of this patent is extended or adjusted under 35 U.S.C. 154(b) by 458 days.

(21) Appl. No.: 13/711,423

(22) Filed: Dec. 11, 2012

(51) Int. Cl.
*H01Q 1/12* (2006.01)
*H01Q 13/10* (2006.01)
*H01Q 1/18* (2006.01)

(52) U.S. Cl.
CPC ..... *H01Q 1/185* (2013.01); *H01Q 13/10* (2013.01)

(58) Field of Classification Search
CPC ..... H01Q 1/185; H01Q 13/10
See application file for complete search history.

(56) References Cited

U.S. PATENT DOCUMENTS

| | | | | |
|---|---|---|---|---|
| 4,638,322 | A * | 1/1987 | Lamberty | 343/761 |
| 4,933,682 | A | 6/1990 | Vaughan | |
| 4,983,988 | A | 1/1991 | Franke | |
| 5,194,874 | A * | 3/1993 | Perrotta | 343/757 |
| 5,469,181 | A | 11/1995 | Yarsunas | |
| 5,589,843 | A | 12/1996 | Meredith et al. | |
| 6,665,546 | B2 | 12/2003 | Slaughter et al. | |
| 7,218,289 | B2 * | 5/2007 | Trajkovic et al. | 343/882 |
| 7,680,516 | B2 | 3/2010 | Lovberg et al. | |
| 7,683,845 | B2 * | 3/2010 | Wynn | 343/757 |
| 8,090,411 | B2 | 1/2012 | Korevaar et al. | |
| 2002/0177405 | A1 | 11/2002 | Chedester et al. | |
| 2005/0001778 | A1 * | 1/2005 | Le et al. | 343/810 |
| 2005/0179610 | A1 * | 8/2005 | Le et al. | 343/797 |
| 2008/0074338 | A1 | 3/2008 | Vacanti | |
| 2008/0088521 | A1 * | 4/2008 | Le et al. | 343/818 |
| 2014/0057570 | A1 * | 2/2014 | Leiba | 455/63.4 |
| 2014/0370925 | A1 * | 12/2014 | Leiba | 455/505 |

FOREIGN PATENT DOCUMENTS

WO WO 2005062428 A1 7/2005

* cited by examiner

*Primary Examiner* — Trinh Dinh
(74) *Attorney, Agent, or Firm* — Active Knowledge Ltd.

(57) ABSTRACT

Various embodiments of a millimeter-wave wireless point-to-point or point-to-multipoint communication system which maintains a stable communication link even in the face of mechanical vibration of the transceivers. The system comprises a transmitter, a receiver, a high-gain antenna, and allied equipment as described. In various embodiments, the system is planned and engineered to maintain the communication link even at a maximum vibration of X/2 degrees in either an up or down direction. In some embodiments, the system uses the energy of a concentrated horizontal beam-width to compensation for the energy pattern in a dispersed vertical beam-width. The system may be set to compensate for different degrees of vibration. The system may be set to maintain different degrees of communication gain.

28 Claims, 8 Drawing Sheets

SYSTEMS AND METHODS FOR VIBRATION AMELIORATION IN A MILLIMETER-WAVE COMMUNICATION NETWORK

BACKGROUND

In PTP and PTMP millimeter-wave networks, transceivers at remote points are aligned with each other, such that a directional connection is achieved. However, many point-to-point ("PTP") and point-to-multipoint ("PTMP") wireless communication networks suffer from a problem of vibration associated with the transmission pole, tower, or other structure that supports the radio transceivers. This problem can arise from a variety of causes, including, among others, wind, vibration from passing vehicles, or shifting ground in which the supporting structure is anchored. Over time, the supporting structure may be subject to metal fatigue or other mechanical stress, which can exacerbate the condition, and increase the effects of the causative factors. If there is too much vibration at one of the transceivers, there will be too much movement in that transceiver for it to maintain communication with one or more of its matched remote transceivers. The result is a breakdown of communication during the time of the vibration. This problem is particularly severe in millimeter-wave communication networks, but the problem is not limited to such networks.

Solutions that have been offered included mechanical means of reducing vibration of the transceivers. One example would be the use of a stronger kind of material in the supporting structure. A second example would be the use of an improved non-corrosive kind of material in the supporting structure. A third example would be the thickening, or otherwise strengthening, of the material in the supporting structure. A fourth example would be adding lines to the supporting structure, such as metal cables, buttresses, and the like. A fifth example would be the driving of the support structure deeper into the ground. A sixth example would be to add a kind of root system in that part of the structure beneath the level of the ground.

These are all mechanical solutions. They can reduce the severity of the problem, but they cannot solve the problem. Even with these solutions, vibrations in transceivers of PTP and PTMP networks continue to create communication difficulties in such networks.

SUMMARY

Described herein are systems and methods in PTP and PTMP wireless communication networks, wherein the network is engineered in such a manner as to maintain communication between remote transceivers, even in the face of mechanical vibrations to one or more of such transceivers. Also described herein are methods for maintaining substantially constant transmission power from one remote transceiver to another remote transceiver, even during mechanical vibration of one or more of the remote transceivers.

One embodiment is a millimeter-wave communication system operative to maintain a stable point-to-point communication link under mechanical vibration conditions. In one particular form of such an embodiment, the system includes a millimeter-wave transmitter, a millimeter-wave receiver that is located a distance away from the millimeter-wave transmitter, and a high-gain antenna belonging to the millimeter-wave transmitter and mounted on an elevated structure that vibrates mechanically such that said vibration causes said high-gain antenna to point to a direction which varies up and down by no more than a given number of total degrees X, where the maximum vibration in either direction up or down is X/2. In this particular form of the embodiment, the high-gain antenna is operative to generate a radiation pattern having a horizontal beam-width that is less than X degrees and a vertical beam-width that is substantially X degrees. Also in this particular form of the embodiment, the horizontal beam-width is operative to provide the high-gain antenna with high gain, and the vertical beam-width is operative to allow the millimeter-wave transmitter to maintain stable communication with the millimeter-wave receiver despite the vibration, via said high-gain antenna and using millimeter-waves.

One embodiment is a high-gain antenna system operative to compensate for vertical angular movement. In one particular form of such an embodiment, the system includes an elevated structure that is susceptible to sway under wind load, and a high-gain antenna that belongs to a millimeter-wave transmitter or a millimeter-wave receiver, that is mounted on said elevated structure, and that is subject to vertical angular movement caused by said sway. In this particular form of such an embodiment, the high-gain antenna is operative to (i) compensate for the vertical angular movement by generating a beam having vertical beam-width that is intentionally wide, and (ii) compensate for loss of gain resulting from the vertical beam-width, by generating the beam with a horizontal beam-width that is narrower than the vertical beam-width.

One embodiment is a method for maintaining a substantially constant transmission power toward a predetermined direction, using a high-gain millimeter-wave beam in a system subject to substantial vertical angular movement. In one particular form of such embodiment, there is mounted a high-gain antenna, having a gain of above 20 dBi, on an elevated structure that is subject to a maximum vertical angular movement of between 3 and 10 degrees. The high-gain antenna radiates a millimeter-wave beam having: (i) a vertical beam-width that is large enough to compensate for the maximum vertical angular movement, and (ii) a horizontal beam-width that is at most one-half of the vertical beam-width, and that is operative to maintain the gain of above 20 dBi.

One embodiment is a method for a method for maintaining a substantially constant transmission power toward a predetermined direction, using a high-gain millimeter-wave beam, in a system subject to substantial vertical angular movement. In one particular form of such embodiment, there is mounted a high-gain antenna, having a gain of above 30 dBi, on an elevated structure that is subject to a maximum vertical angular movement of between 2 and 5 degrees. The high-gain antenna radiates a millimeter-wave beam having: (i) a vertical beam-width that is large enough to compensate for the maximum vertical angular movement, and (ii) a horizontal beam-width that is at most one-half of the vertical beam-width, and that is operative to maintain the gain of above 30 dBi.

BRIEF DESCRIPTION OF THE DRAWINGS

The embodiments are herein described, by way of example only, with reference to the accompanying drawings. No attempt is made to show structural details of the embodiments in more detail than is necessary for a fundamental understanding of the embodiments. In the drawings.

DETAILED DESCRIPTION

Throughout this written description and the claims, the term "beam" is exactly the same thing as "radiation pattern". In all cases, the intent is that the transmission of a transmitter mounted on a supporting structure in a PTP or PTMP system, creates a particular configuration or pattern or radiation energy.

Throughout this written description and the claims, the term "central path" is the central line of communication that has been planned and engineered between two transceivers in a PTP or PTMP network. The term "sway", defined below, refers to causing a deviation up or down from the "central path" or two transceivers.

Throughout this written description and the claims, the term "structure" in conjunction with the word "elevated" means the physical structure that elevates and supports a transceiver in a PTP or PTMP network. The term may appear as "elevated structure". The term may appear as "supporting structure", which means here the same thing as "elevated structure".

PTP is short for "point-to-point", and signifies a wireless communication system in which there is communication between a transmitter and a receiver which are located remotely from one another, and in which the planned communication path between the transmitter and the receiver is the "central path".

PTMP is short for "point-to-multipoint", and signifies a wireless communication system in which there is communication between a transmitter and each of two or more receivers, all of which receivers being located remotely from the transmitter, and in which the planned communication path between the transmitter and a particular receiver is the "central path" for that pair of transmitter and receiver.

FIGS. 1A, 1B, 1C, 2A, 2B, 3A, and 3B, inclusive, illustrate various embodiments of millimeter-wave communication system.

Figure 1A:
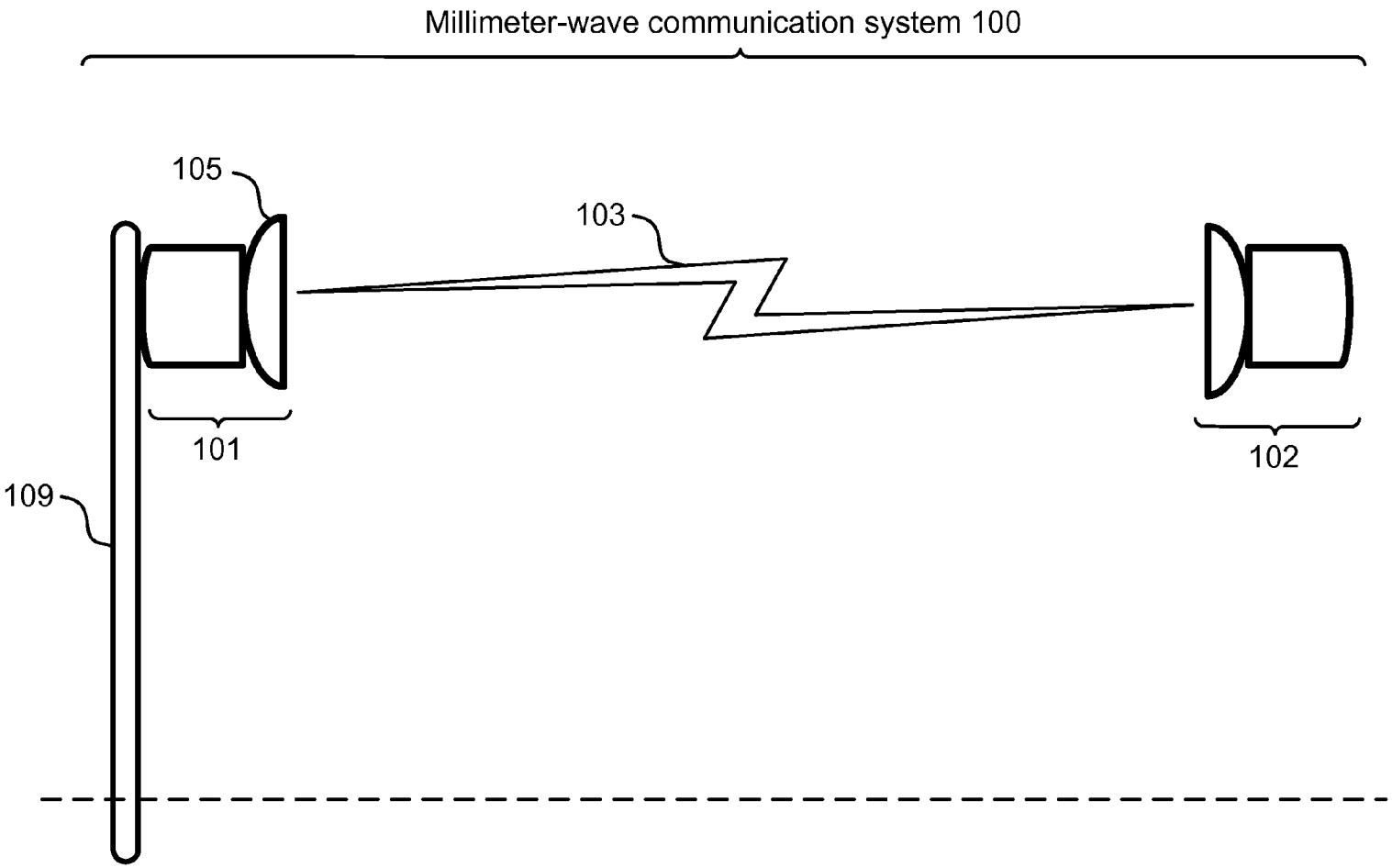
FIG. 1A illustrates one embodiment of a millimeter-wave point-to-point ("PTP") communication system.

FIG. 1A illustrates one embodiment of a millimeter-wave communication system 100. In FIG. 1A, the millimeter-wave communication system 100 includes a transmitter 101 which itself includes an antenna with a dish reflector 105, in which the entire transmitter 101 is mounted an a supporting structure 109, which may be a pole, tower, or other structure, said structure made of metal, wood, concrete, or any other shape-retaining material. The supporting structure 109 is rooted in the ground. The transmitting antenna with dish reflector 105 transmits a communication wave 103 to a receiver 102.

Figure 1D:
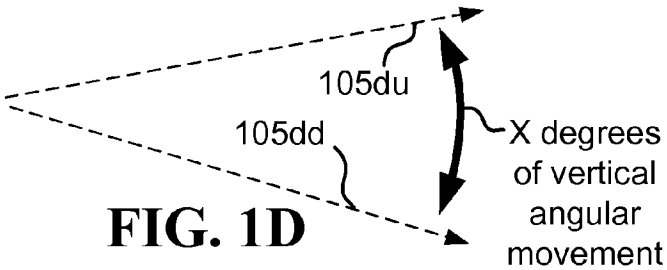
FIG. 1D illustrates one embodiment of a millimeter-wave PTP or PTMP communication system, in which there is a central path with potential deviation due to vertical angular movement of the supporting structure equal to X degrees, in which the potential deviation up is substantially X/2 degrees and the potential deviation down is substantially X/2 degrees.
Figure 1C:
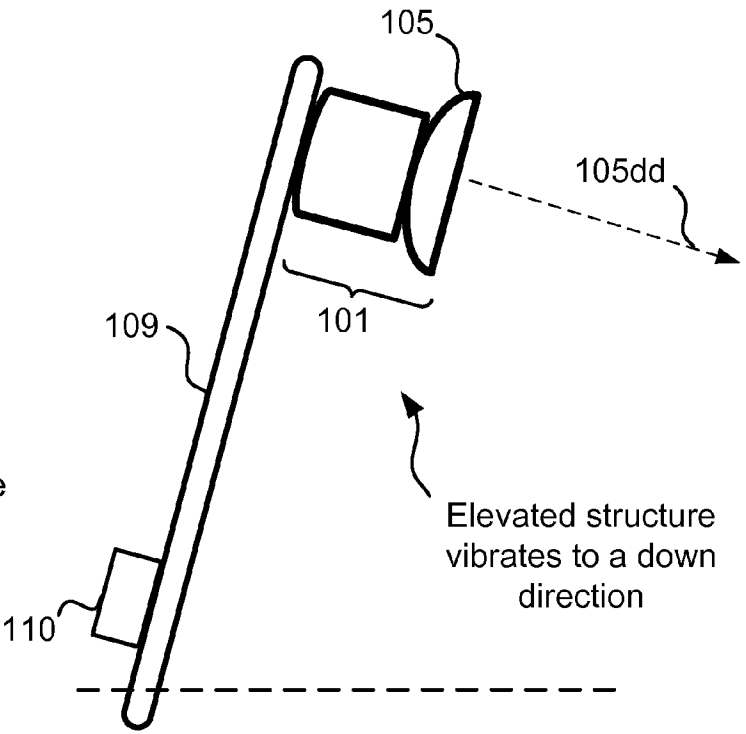
FIG. 1C illustrates one embodiment of a transceiver in a millimeter-wave PTP or PTMP communication system, in which vibration down of a supporting structure on which the transceiver is mounted causes the transceiver to transmit X/2 degrees below the planned path.
Figure 1B:
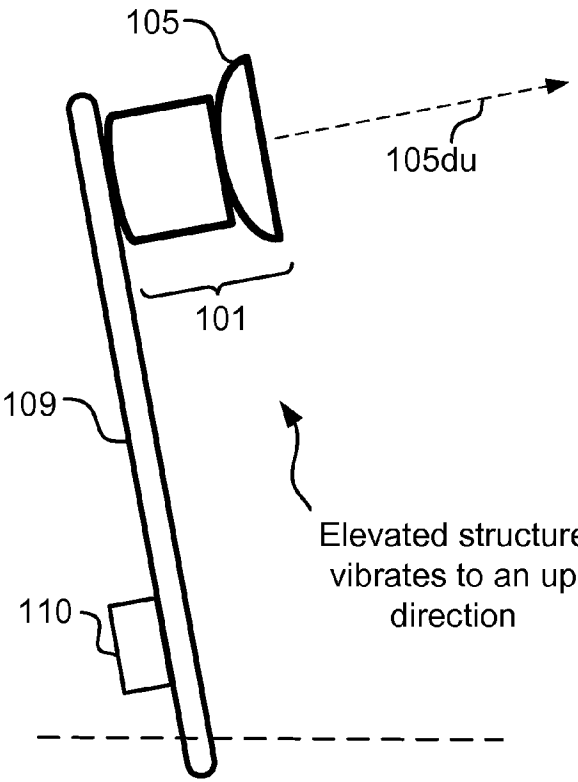
FIG. 1B illustrates one embodiment of a transceiver in a millimeter-wave PTP or PTMP communication system, in which vibration up of a supporting structure on which the transceiver is mounted causes the transceiver to transmit X/2 degrees above the planned path.

FIG. 1B illustrates one embodiment of part of a millimeter-wave communication system. In FIG. 1B, vibration has caused the supporting structure 109 to redirect the transmitter 101, such the signal transmitted by transmission antenna with dish reflector 105 has been redirected up 105*du* from the central path.

FIG. 1C illustrates one embodiment of part of a millimeter-wave communication system. In FIG. 1C, vibration has caused the supporting structure 109 to redirect the transmitter 101, such the signal transmitted by transmission antenna with dish reflector 105 has been redirected down 105*dd* from the central path.

FIG. 1D illustrates one embodiment of part of a millimeter-wave communication system. In FIG. 1D, the path of a beam from a transmitter may fall on a central path between a transmitter and a receiver, or may fall within any part of X degrees of vertical angular movement, such that maximum deviation up from the central path is 105*du*, equal to a maximum of X/2 degrees, and maximum deviation down from the central path is 105*dd*, equal to a maximum of X/2 degrees.

Figure 2A:
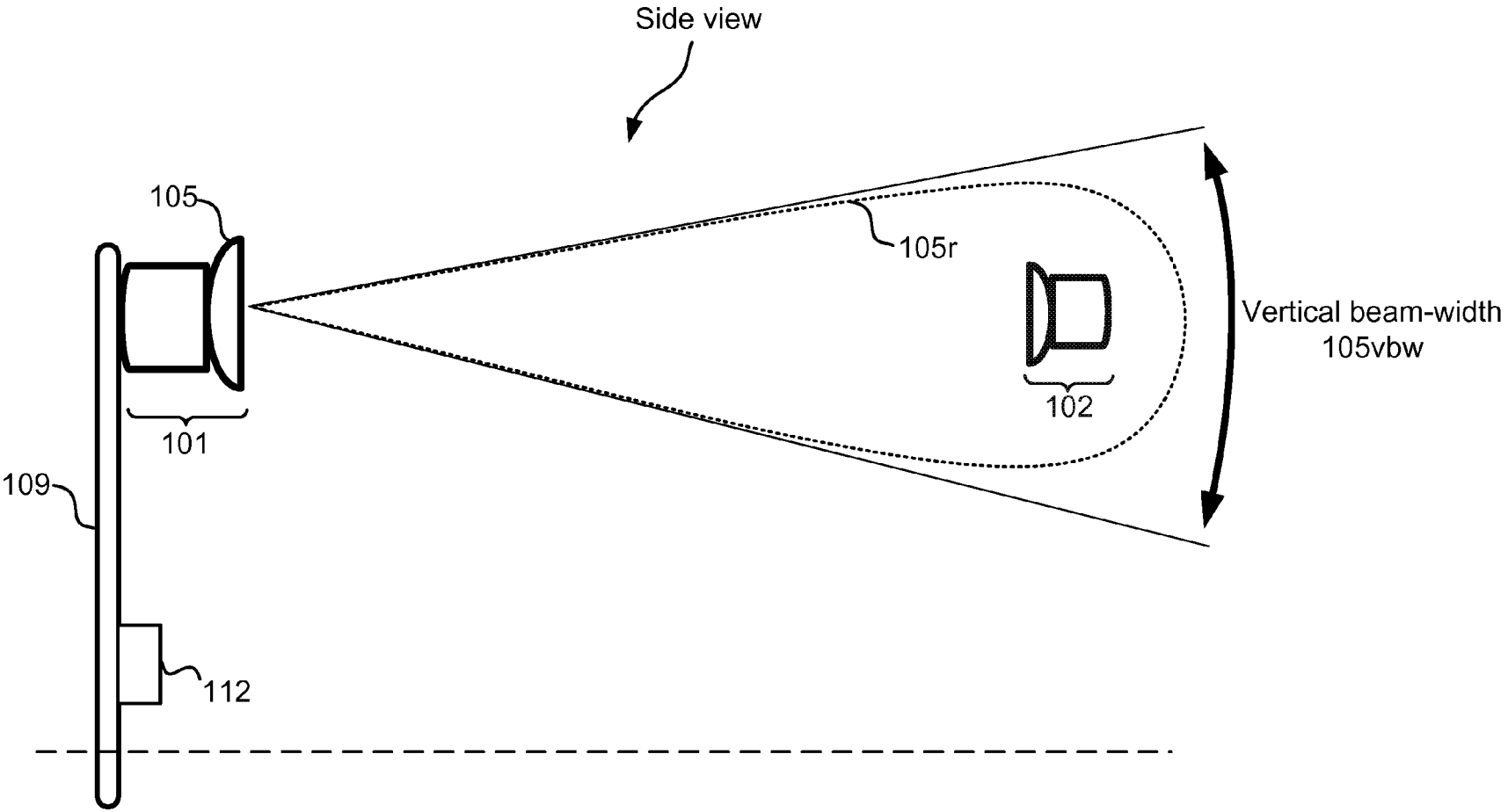
FIG. 2A illustrates one embodiment of a millimeter-wave PTP or PTMP communication system in which there is a side view of the vertical beam-width generated by a transmitter mounted on a supporting structure.

FIG. 2A illustrates one embodiment of a millimeter-wave communication system. In FIG. 2A, there is a transmitter 101 mounted on a supporting structure 109. The transmission antenna with dish reflector 105 transmits a signal to a receiver 102. In a side view of the signal, the beam appears as 105*r*, where the total vertical beam-width is measured in degrees and equals 105*vbw*. Maximum communication gain is the point at which the radiation pattern extends farthest from the source 105, as shown as the maximum point on the right of the dotted line representing radiation pattern 105*r*. For example, but not as a limiting case, the maximum gain at this point might be 30 dBi, which would mean that the gain at any point other than this maximum point would be less than 30 dBi.

Figure 2B:
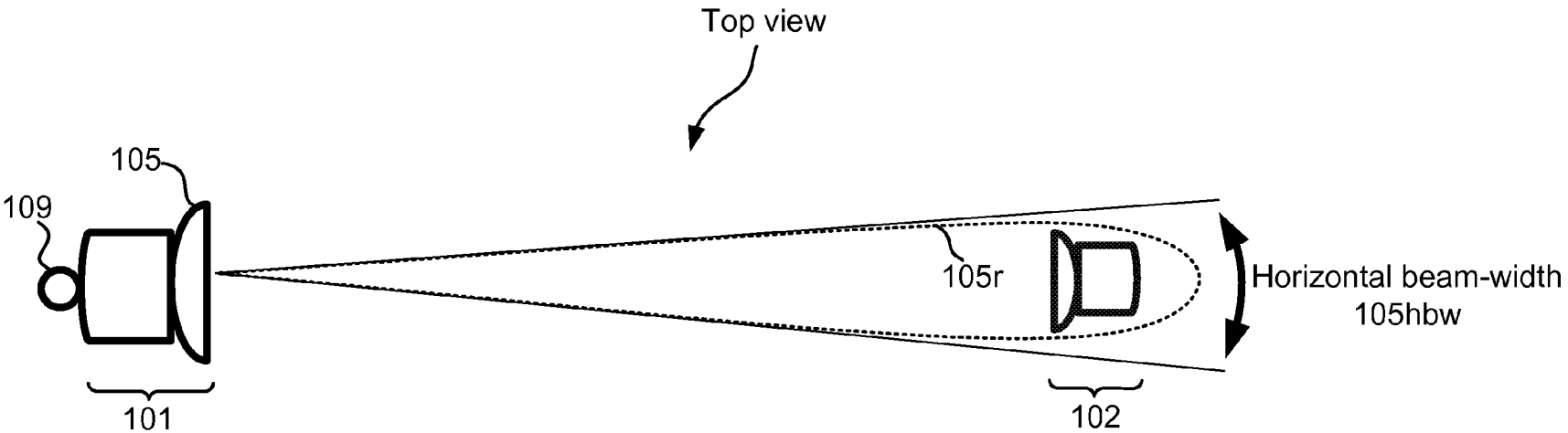
FIG. 2B illustrates one embodiment of a millimeter-wave PTP or PTMP communication system in which there is a top view of the horizontal beam-width generated by a transmitter mounted on a supporting structure.

FIG. 2B illustrates one embodiment of a millimeter-wave communication system. In FIG. 2B, there is a transmitter 101 mounted on a supporting structure 109. The transmission antenna with dish reflector 105 transmits a signal to a receiver 102. In a top view of the signal, the beam appears as 105*r*, where the total horizontal beam-width is measured in degrees and equals 105*hbw*. Maximum communication gain is the point at which the radiation pattern extends farthest from the source 105, as shown as the maximum point on the right of the dotted line representing radiation pattern 105*r*. For example, but not as a limiting case, the maximum gain at this point might be 30 dBi, which would mean that the gain at any point other than this maximum point would be less than 30 dBi.

Taking FIGS. 2A and 2B together, in the particular embodiment shown, vertical beam-width 105*vbw* is greater than the horizontal beam-width 105*hbw*, which means that the radiation energy is more concentrated in the horizontal direction rather than the vertical direction.

Figure 3A:
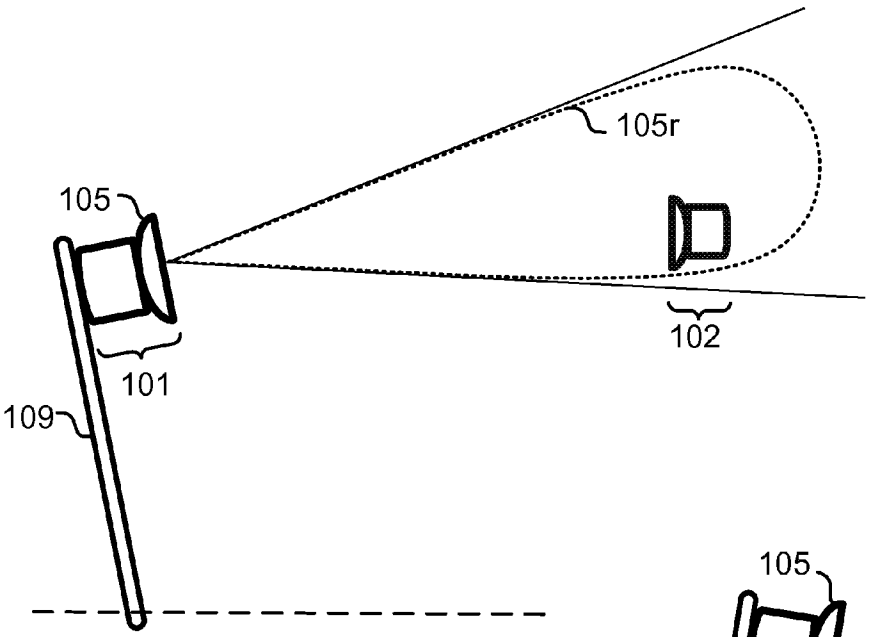
FIG. 3A illustrates one embodiment of a millimeter-wave PTP or PTMP communication system in which there is transmitter mounted on a supporting structure subject to vibration causing the transmission wave to deviate up from the central path, but the system is engineered such that the receiver is still within the communication beam of the transmitter.

FIG. 3A illustrates one embodiment of a millimeter-wave communication system, in which there is transmitter 101 mounted on a supporting structure 109 subject to vibration, causing the transmission antenna with dish reflector 105 to direct the signal in a direction that deviates up from a central path, and creates a radiation pattern illustrated in 105*r*. However, the system has been engineered such that despite the deviation, the receiver 102 is still within the radiation beam 105*r* of the transmission, which means that there continues to be communication between the transmitter 101 and the receiver 102.

There may be at least two parts to the solution to the problem of vibration. In a first part of the solution, the system has been engineered to tolerate a certain amount of vibration. For example, but not as a limiting case, assume that the supporting structure 109 deviates from the absolute vertical by 5 degrees. This would cause the transmission antenna with reflector dish 105 to direct the signal such that radiation pattern 105*r* would be centered 5 degrees up from the central path. However, due to system planning and engineering, the receiver 102 remains within radiation pattern 105*r*, even though such pattern 105*r* deviates to a maximum of 5 degrees up from the central path.

In a second part of the solution, as the vertical beam-width 105*vbw* widens, communication between transmitter 101 and receiver 102 becomes possible despite a greater vibration of supporting structure 109. However, at the same time, a wider beam-width 105*vbw* causes a loss of dBi gain between the transmitter 101 and the receiver 102. To compensate for this loss, the horizontal beam-width 105*hbw* is narrowed, thereby concentrating the radiation energy 105*r* in the path between the transmitter 101 and the receiver 102. In his way, loss of energy due to vertical beam-width dispersion is at least partly compensated by gain of energy due to horizontal beam-width concentration.

Figure 3B:
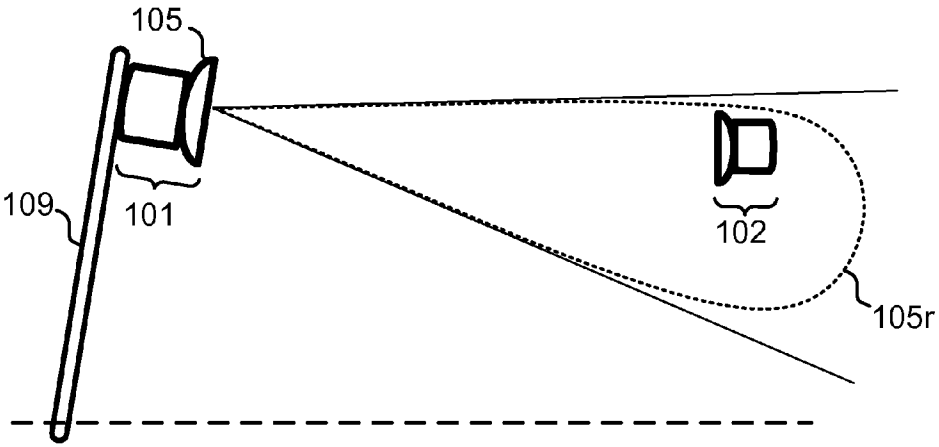
FIG. 3B illustrates one embodiment of a millimeter-wave PTP or PTMP communication system in which there is transmitter mounted on a supporting structure subject to vibration causing the transmission wave to deviate down from the central path, but the system is engineered such that the receiver is still within the communication beam of the transmitter.

FIG. 3B illustrates one embodiment of a millimeter-wave communication system, in which there is transmitter 101 mounted on a supporting structure 109 subject to vibration, causing the transmission antenna with dish reflector 105 to direct the signal in a direction that deviates down from a central path, and creates a radiation pattern illustrated in 105*r*. However, the system has been engineered such that despite the deviation, the receiver 102 is still within the radiation beam 105*r* of the transmission, which means that there continues to be communication between the transmitter 101 and the receiver 102.

Figure 4:
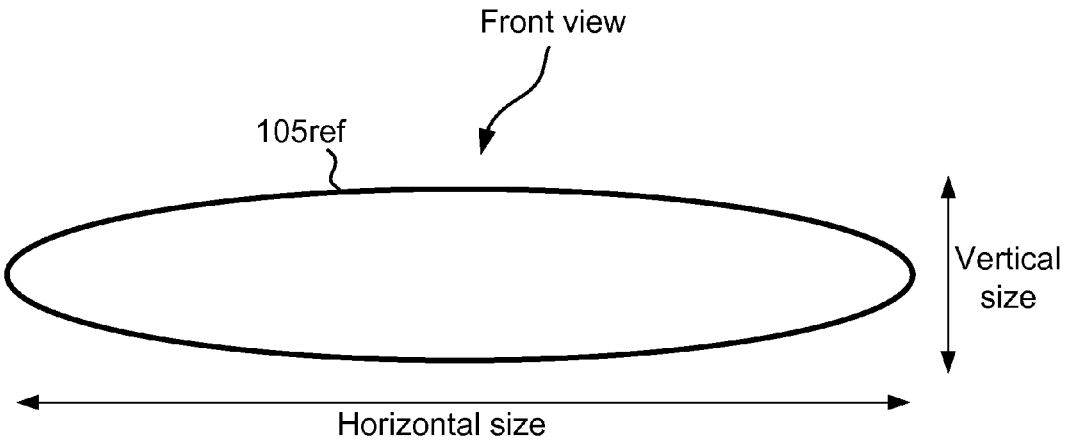
FIG. 4 illustrates one embodiment of a millimeter-wave PTP or PTMP communication system in which there is a front view of an aperture in a dish reflector, such that the shape of the aperture will shape a pattern of radiation energy where the radiation pattern will be relatively broader in the vertical direction and relatively narrower in the horizontal direction.

FIG. 4 illustrates one embodiment of a communication system in which there is a front view of an aperture in a dish reflector, such that the shape of the aperture will shape a pattern of radiation energy where the radiation pattern will be relatively broader in the vertical direction and relatively narrower in the horizontal direction. In FIG. 4, there is a front view of the aperture 105*ref* of the antenna in a dish reflector. The antenna in dish reflector 105, not shown in FIG. 4, conveys radiation energy whose dispersion is shaped in accordance with the aperture 105*ref*. This particular aperture 105*ref* has a horizontal dimension that is significantly longer than the vertical dimension. These relative differences produce a radiation pattern in which the radiation dispersion is greater in the vertical beam-width than in the horizontal beam-width, which, as explained previously, creates concentrated horizontal radiation energy that can help offset or moderate the effect of widely dispersed vertical radiation energy which keeps a receiver in the beam of a transmitter even in the case of vibration of the supporting structure of the transmitter.

Figure 5:
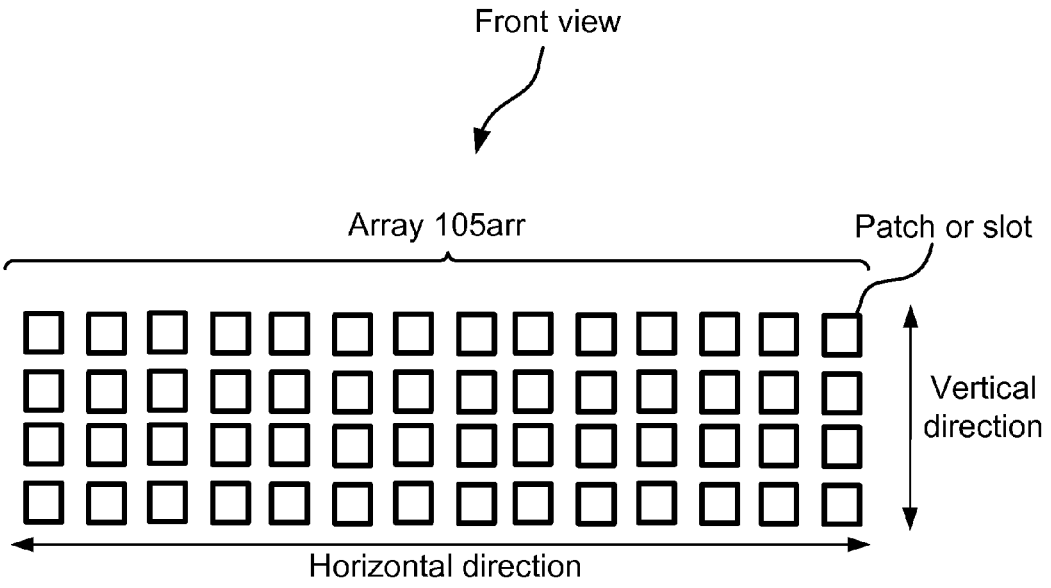
FIG. 5 illustrates one embodiment of a millimeter-wave PTP or PTMP communication system in which there is a phased array, such that the horizontal direction of the array is significantly longer than the vertical dimension of the array, thereby causing the radiation pattern to be relatively broader in the vertical direction and relatively narrower in the horizontal direction.

FIG. 5 illustrates one embodiment of a communication system in which there is a front view of a phase array antenna, such that the position of patch or slot elements of the phased array will shape a pattern of radiation energy where the radiation pattern will be relatively broader in the vertical direction and relatively narrower in the horizontal direction. In FIG. 5, there is a front view of a phased array antenna 105*arr*. The phased array 105*arr* conveys radiation energy whose dispersion is shaped in accordance with the array 105*arr*. This particular array 105*arr* has a horizontal dimension that is significantly longer than the vertical dimension. These relative differences produce a radiation pattern in which the radiation dispersion is greater in the vertical beam-width than in the horizontal beam-width, which, as explained previously, creates concentrated horizontal radiation energy that can help offset or moderate the effect of widely dispersed vertical radiation energy which keeps a receiver in the beam of a transmitter even in the case of vibration of the supporting structure of the transmitter.

In one embodiment, there is a millimeter-wave communication system 100 operative to maintain a stable point-to-point communication link 103 under mechanical vibration conditions. The millimeter-wave communication system 100 includes a millimeter-wave transmitter 101 that communicates with a millimeter-wave receiver 102 located some distance away from the millimeter-wave transmitter 101. The communication system also includes a high-gain antenna 105, belonging to the millimeter-wave transmitter 101, wherein the transmitter 101 is mounted on an elevated structure 109. The elevated structure 109 vibrates mechanically such that the vibration causes the high-gain antenna to point to a direction which varies up 105*du* or down 105*dd* from a central path between the transmitter 101 and the receiver 102, whereby by the maximum vibration is no more than a total of X degrees, meaning no more than X/2 degrees up and no more than X/2 degrees down. The high-gain antenna 105 is operative to generate a radiation pattern 105*r* having a horizontal beam-width 105*hbw* that is less than X degrees, and a vertical beam-width 105*vbw* that is substantially X degrees. The horizontal beam-width 105*hbw* is operative to provide the high-gain antenna 105 with high gain, and the vertical beam-width 105*vbw* is operative to allow the millimeter-wave transmitter 101 to maintain stable communication with the millimeter-wave receiver 102 despite the vibration, via said high-gain antenna 101 and using millimeter-waves.

In a first alternative embodiment of the system just described for a millimeter-wave communication system 100, during vibration of the elevated structure, the millimeter-wave receiver 102 does not go outside coverage of the high-gain antenna 101, thereby facilitating stable communication between the transmitter 101 and the receiver 102. One reason for the result that the receiver 102 does not go outside the coverage of the high-gain antenna 101 is that the radiation pattern 105*r* has a vertical beam-width 105*vbw* that is substantially the same as the maximum variation in degrees of the direction to which the high-gain antenna 101 points.

In a first possible configuration of the first alternative embodiment just described, the vertical beam-width 105*vbw* is operative to compensate for the vibration of the elevated structure 109.

In a second alternative embodiment of the system described for a millimeter-wave communication system 100, the vibration of the elevated structure 109 is caused primarily by wind.

In a first possible configuration of the second alternative embodiment just described, the wind causes an upper portion of the elevated structure 109 to move back and forth, away and toward, respectively, the millimeter-wave receiver 102. At the same time, a lower portion of said elevated structure 109 is held fixed by the ground, thereby causing said high-gain antenna 101 to point in a direction which varies up and down.

In one possible variation of the first possible configuration of the second alternative embodiment just described, the vibration in the elevated structure 109 resonates with the wind.

In a third alternative embodiment of the system described for a millimeter-wave communication system 100, the vibration is caused primarily by a mechanically vibrating device located on or nearby the elevated structure 109.

In a fourth alternative embodiment of the system described for a millimeter-wave communication system 100, the vibration is a movement of the elevated structure 109.

In a first possible configuration of the fourth alternative embodiment just described, the movement is caused over time, at least in part, by mechanical stresses exerted on the elevated structure 109. Such mechanical stresses, could, but are not necessarily, be caused by the weight of the load on the elevated structure 109 and the elasticity of the elevated structure 109.

In a second possible configuration of the first alternative embodiment just described, the movement is caused, at least in part, by a change of load placed on the elevated structure 109.

In a fifth alternative embodiment of the system described for a millimeter-wave communication system 100, the elevated structure 109 is a pole. This pole could be a street light post, a sign post, a utility pole, a pole specifically dedicated to the communication system 100, or another kind of pole.

In a sixth alternative embodiment of the system described for a millimeter-wave communication system 100, the elevated structure 109 is a communication tower.

In a seventh alternative embodiment of the system described for a millimeter-wave communication system 100, the horizontal beam-width 105*hbw* is between 2 degrees and 4 degrees, and the vertical beam-width 105*vbw* is between 6 degrees and 10 degrees. Since the vertical beam-width 105*vbw* is between 6 degrees and 10 degrees, necessarily X is between 6 degrees and 10 degrees, since X degrees is the same measure as the degrees of the vertical beam-width 105*vbw*.

In one possible non-limiting example of the seventh alternative embodiment of the system described for a millimeter-wave communication system 100, the horizontal beam-width is 3 degrees, meaning 1.5 degrees to either left or right of the central path, and the vertical beam-width is 8 degrees, meaning 4 degrees either up or down from the central path. In this non-limiting example, X is also 8 degrees, meaning 4 degrees up or down from the central path.

In a first possible configuration of the seventh alternative embodiment of the millimeter-wave communication system 100, the high-gain of the high-gain antenna 105 is between 30 dBi and 35 dBi. In one specific non-limiting example, the high-gain is 32 dBi.

In a second possible configuration of the seventh alternative embodiment of the millimeter-wave communication system 100, the operating frequency of the high-gain antenna 105 is between 50 GHz and 80 GHz. In one specific non-limiting example, the operating frequency of the high-gain antenna 105 is between 57 GHz and 64 GHz.

In an eighth alternative embodiment of the system described for a millimeter-wave communication system 100, the horizontal beam-width 105*hbw* is between 1 degree and 6 degrees, and the vertical beam-width 105*vbw* is between 7 degrees and 12 degrees.

In a ninth alternative embodiment of the system described for a millimeter-wave communication system 100, the high-gain antenna 105 is a reflector antenna 105*ref*.

In a first possible configuration of the ninth alternative embodiment just described, a horizontal size of the reflector antenna 105*ref* is bigger than a vertical size of the reflector antenna 105*ref*, thereby facilitating generation of a radiation pattern 105*r* having a horizontal beam-width 105*bhw* that is less than X degrees, and a vertical beam-width 105*vbw* that is substantially X degrees. As explained previously, there is an inverse relationship between dimension size and beam-width, which is to say, the greater the dimension size, the less the beam-width, and the lesser the dimension size, the greater the beam-width.

In a second possible configuration of the ninth alternative embodiment just described, said high-gain antenna 105 is a shaped parabolic antenna, having a vertical shape operative to de-focuses said radiation pattern in the vertical direction, thereby facilitating generation of said radiation pattern having a horizontal beam-width that is less than X degrees and a vertical beam-width that is substantially X degrees.

In a tenth alternative embodiment of the system described for a millimeter-wave communication system 100, the high-gain antenna 105 is an array 105*arr* of patches or slots.

In a first possible configuration of the tenth alternative embodiment just described, there are more patches or slots in a horizontal direction of the array 105*arr* than there are patches or slots in a vertical direction of the array 105*arr*, thereby facilitating generation of a radiation pattern 105*r* having a horizontal beam-width 105*hbw* that is less than X degrees and a vertical beam-width 105*vbw* that is substantially X degrees.

In a eleventh alternative embodiment of the system described for a millimeter-wave communication system 100, the radiation patter 105*r* has a horizontal beam-width 105*hbw* that is less than X/2 degrees and a vertical beam-width 105*vbw* that is substantially X degrees.

In a first possible configuration of the eleventh alternative embodiment just described, the high-gain of the high-gain antenna 105 is higher than 20 dBi, and the operating frequency of the high-gain antenna 105 is between 30 GHz and 80 GHz.

In a second possible configuration of the eleventh alternative embodiment just described, the high-gain of the high-gain antenna 105 is higher than 30 dBi, and the operating frequency of the high-gain antenna 105 is between 30 GHz and 80 GHz.

In a twelfth alternative embodiment of the system described for a millimeter-wave communication system 100, the radiation patter 105*r* has a horizontal beam-width 105*hbw* that is less than X/4 degrees and a vertical beam-width 105*vbw* that is substantially X degrees.

In a first possible configuration of the twelfth alternative embodiment just described, the high-gain of the high-gain antenna 105 is higher than 25 dBi, and the operating frequency of the high-gain antenna 105 is between 30 GHz and 80 GHz.

In a second possible configuration of the twelfth alternative embodiment just described, the high-gain of the high-gain antenna 105 is higher than 35 dBi, and the operating frequency of the high-gain antenna 105 is between 30 GHz and 80 GHz.

In a thirteenth alternative embodiment of the system described for a millimeter-wave communication system 100, the vibration causes the high-gain antenna 105 to point in a direction which varies up 105*du* and down 105*dd* from a central path between a transmitter 101 and a receiver 102 by an amount of between X/2 degrees and X degrees.

In a fourteenth alternative embodiment of the system described for a millimeter-wave communication system 100, the vibration causes the high-gain antenna 105 to point in a direction which varies up 105*du* and down 105*dd* from a central path between a transmitter 101 and a receiver 102 by an amount of between X/4 degrees and X degrees.

In one embodiment, there is high-gain antenna system operative to compensate for vertical angular movement. The system includes an elevated structure 109 susceptible to sway under wind load, and a high-gain antenna 105 belonging to a millimeter-wave transmitter 101 or a millimeter-wave receiver 102. The high-gain antenna 105 is mounted on the elevated structure 109, and subject to vertical angular movement caused by the sway. The high-gain antenna 105 is operative to: (i) compensate for the vertical angular movement by generating a beam 105*r* having a vertical beam-width 105*vbw* that is intentionally wide, and (ii) compensate for loss of gain resulting from the vertical beam-width 105*vbw*, wherein the high-gain antenna 105 achieves the compensation by generating the beam 105*r* with a horizontal beam-width 105*hbw* that is narrower than the vertical beam-width 105*vbw*.

In a first alternative embodiment of the system just described for a high-gain antenna system operative to compensate for vertical angular movement, during the sway, the beam 105*r* illuminates a singular angular direction with a power level that does not fluctuate by more than 3 dB despite the sway. In one non-limiting example, the "singular angular direction" is the direction in which the receiver 102 is placed relative to the transmitter 101.

In a second alternative embodiment of the system just described for a high-gain antenna system operative to compensate for vertical angular movement, the horizontal beam-width 105*hbw* is between 2 degrees and 4 degrees, and the vertical beam-width 105*vbw* is between 6 degrees and 10 degrees. In one non-limiting example, the horizontal beam-width 105*hbw* is 3 degrees, meaning 1.5 degrees up and also 1.5 degrees down from a central path between a transmitter 101 and a receiver 102, and the vertical beam-width 105*vbw* is 8 degrees, meaning 4 degrees up and also 4 degrees down from a central path between a transmitter 101 and a receiver 102.

In a first possible configuration of the second alternative embodiment just described, the high-gain of the high-gain antenna 105 is between 30 dBi and 35 dBi. In one non-limiting example, the high-gain is 32 dBi.

In a third alternative embodiment of the system just described for a high-gain antenna system operative to compensate for vertical angular movement, the horizontal beam-width 105*hbw* is between 1 degree and 4 degrees, and the vertical beam-width 105*vbw* is between 7 degrees and 12 degrees.

In a fourth alternative embodiment of the system just described for a high-gain antenna system operative to compensate for vertical angular movement, the horizontal beam-width 105*hbw* is less than one-half of the vertical beam-width 105*vbw*.

In a first possible configuration of the fourth alternative embodiment just described, the high-gain of said high-gain antenna 105 is higher than 20 dBi, and the operating frequency of said high-gain antenna 105 is between 30 GHz and 80 GHz.

In a second possible configuration of the fourth alternative embodiment just described, the high-gain of said high-gain antenna 105 is higher than 30 dBi, and the operating frequency of said high-gain antenna 105 is between 30 GHz and 80 GHz.

In a fifth alternative embodiment of the system just described for a high-gain antenna system operative to compensate for vertical angular movement, the horizontal beam-width 105*hbw* is less than one-quarter of the vertical beam-width 105*vbw*.

In a first possible configuration of the fifth alternative embodiment just described, the high-gain of said high-gain antenna 105 is higher than 25 dBi, and the operating frequency of said high-gain antenna 105 is between 30 GHz and 80 GHz.

In a second possible configuration of the fifth alternative embodiment just described, the high-gain of said high-gain antenna 105 is higher than 35 dBi, and the operating frequency of said high-gain antenna 105 is between 30 GHz and 80 GHz.

Figure 6:
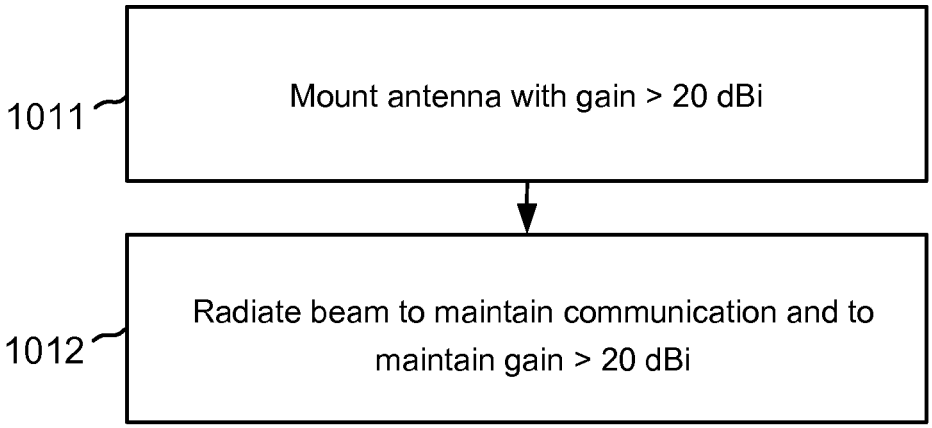
FIG. 6 illustrates a flow diagram describing one method for maintaining a substantially constant transmission power toward a predetermined direction, using a high-gain millimeter-wave beam in a PTP of PTMP communication system subject to substantial vertical angular movement.

FIG. 6 is a flow diagram illustrating one method for maintaining a substantially constant transmission power toward a predetermined direction, such as in the direction of a receiver 102, using a high-gain millimeter-wave beam 105*r*, in a millimeter-wave communication system 100 that is subject to substantial vertical angular movement. In step 1011, mounting a high-gain antenna 105 having a gain of above 20 dBI, which is part of a transceiver 101, on an elevated structure 109 that is subject to a maximum angular movement of between 3 degrees and 10 degrees. In step 1012, radiating the high-gain millimeter-wave beam 105*r* from the high-gain antenna 105 such that the high-gain millimeter-wave beam 105*r* has (i) a vertical beam-width 105*vbw* that is large enough to compensate for the maximum vertical angular movement, and (ii) a horizontal beam-width 105*hbw* that is at most one-half of the vertical beam-width 105*vbw*, operative to maintain the gain of about 20 dBi.

Figure 7:
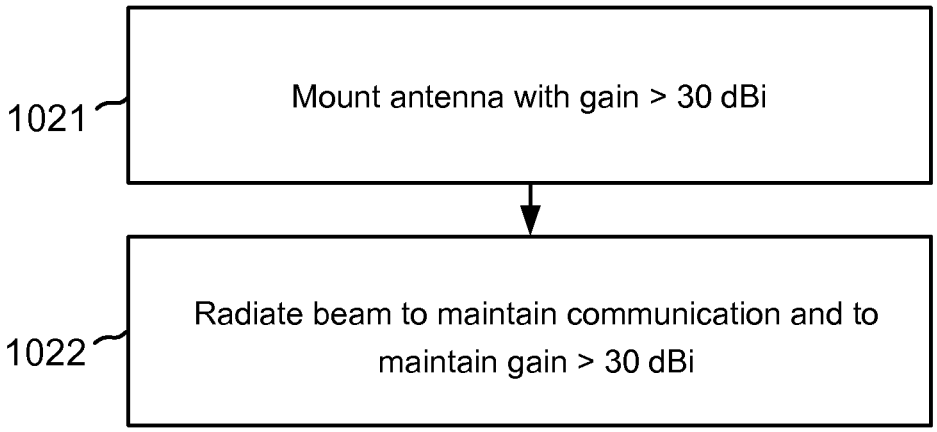
FIG. 7 illustrates a flow diagram describing one method for maintaining a substantially constant transmission power toward a predetermined direction, using a high-gain millimeter-wave beam in a PTP of PTMP communication system subject to substantial vertical angular movement.

FIG. 7 is a flow diagram illustrating one method for maintaining a substantially constant transmission power toward a predetermined direction, such as in the direction of a receiver 102, using a high-gain millimeter-wave beam 105*r*, in a millimeter-wave communication system 100 that is subject to substantial vertical angular movement. In step 1021, mounting a high-gain antenna 105 having a gain of above 30 dBI, which is part of a transceiver 101, on an elevated structure 109 that is subject to a maximum angular movement of between 2 degrees and 5 degrees. In step 1022, radiating the high-gain millimeter-wave beam 105*r* from the high-gain antenna 105 such that the high-gain millimeter-wave beam 105*r* has (i) a vertical beam-width 105*vbw* that is large enough to compensate for the maximum vertical angular movement, and (ii) a horizontal beam-width 105*hbw* that is at most one-half of the vertical beam-width 105*vbw*, operative to maintain the gain of about 30 dBi.

One embodiment is a method for maintaining a substantially constant transmission power toward a predetermined direction, typically toward a receiver, using a high-gain millimeter-wave beam 105*r* in a system subject to substantial vertical angular movement. A high-gain antenna 105, having a gain above 20 dBi, is mounted 1011 on an elevated structure 109 that is subject to a maximum vertical angular movement of between 3 degrees and 10 degrees.

Then, the high-gain antenna radiates 1012 a millimeter-wave beam having (i) a vertical beam-width 105*vbw* that is large enough to compensate for the maximum vertical angular movement of 10 degrees, and (ii) a horizontal beam-width 105*hbw* that is at most one-half of the vertical beam-width 105*vbw*, so that signal transmitted will maintain the communication gain above 20 dBi.

One embodiment is a method for maintaining a substantially constant transmission power toward a predetermined direction, typically toward a receiver 102, using a high-gain millimeter-wave beam 105*r* in a system subject to substantial vertical angular movement. A high-gain antenna 105, having a gain above 30 dBi, is mounted 1021 on an elevated structure 109 that is subject to a maximum vertical angular movement of between 2 degrees and 5 degrees in either an up or a down direction from a central path between a transmitter 105 and a receiver 102.

Then, the high-gain antenna radiates 1022 a millimeter-wave beam having (i) a vertical beam-width 105*vbw* that is large enough to compensate for the maximum vertical angular movement of 5, and (ii) a horizontal beam-width 105*hbw* that is at most one-half of the vertical beam-width 105*vbw*, so that signal transmitted will maintain the communication gain above 30 dBi.

In this description, numerous specific details are set forth. However, the embodiments/cases of the invention may be practiced without some of these specific details. In other instances, well-known hardware, materials, structures and techniques have not been shown in detail in order not to obscure the understanding of this description. In this description, references to "one embodiment" and "one case" mean that the feature being referred to may be included in at least one embodiment/case of the invention. Moreover, separate references to "one embodiment", "some embodiments", "one case", or "some cases" in this description do not necessarily refer to the same embodiment/case. Illustrated embodiments/cases are not mutually exclusive, unless so stated and except as will be readily apparent to those of ordinary skill in the art. Thus, the invention may include any variety of combinations and/or integrations of the features of the embodiments/cases described herein. Also herein, flow diagrams illustrate non-limiting embodiment/case examples of the methods, and block diagrams illustrate non-limiting embodiment/case examples of the devices. Some operations in the flow diagrams may be described with reference to the embodiments/cases illustrated by the block diagrams. However, the methods of the flow diagrams could be performed by embodiments/cases of the invention other than those discussed with reference to the block diagrams, and embodiments/cases discussed with reference to the block diagrams could perform operations different from those discussed with reference to the flow diagrams. Moreover, although the flow diagrams may depict serial operations, certain embodiments/cases could perform certain operations in parallel and/or in different orders from those depicted. Moreover, the use of repeated reference numerals and/or letters in the text and/or drawings is for the purpose of simplicity and clarity and does not in itself dictate a relationship between the various embodiments/cases and/or configurations discussed. Furthermore, methods and mechanisms of the embodiments/cases will sometimes be described in singular form for clarity. However, some embodiments/cases may include multiple iterations of a method or multiple instantiations of a mechanism unless noted otherwise. For example, when a controller or an interface are disclosed in an embodiment/case, the scope of the embodiment/case is intended to also cover the use of multiple controllers or interfaces.

Certain features of the embodiments/cases, which may have been, for clarity, described in the context of separate embodiments/cases, may also be provided in various combinations in a single embodiment/case. Conversely, various features of the embodiments/cases, which may have been, for brevity, described in the context of a single embodiment/case, may also be provided separately or in any suitable sub-combination. The embodiments/cases are not limited in their applications to the details of the order or sequence of steps of operation of methods, or to details of implementation of devices, set in the description, drawings, or examples. In addition, individual blocks illustrated in the figures may be functional in nature and do not necessarily correspond to discrete hardware elements. While the methods disclosed herein have been described and shown with reference to particular steps performed in a particular order, it is understood that these steps may be combined, sub-divided, or reordered to form an equivalent method without departing from the teachings of the embodiments/cases. Accordingly, unless specifically indicated herein, the order and grouping of the steps is not a limitation of the embodiments/cases. Embodiments/cases described in conjunction with specific examples are presented by way of example, and not limitation. Moreover, it is evident that many alternatives, modifications and variations will be apparent to those skilled in the art. Accordingly, it is intended to embrace all such alternatives, modifications and variations that fall within the spirit and scope of the appended claims and their equivalents.

What is claimed is:

1. A millimeter-wave communication system operative to maintain a stable point-to-point communication link under mechanical vibration conditions, comprising:

a millimeter-wave transmitter;

a millimeter-wave receiver, located away from the millimeter-wave transmitter; and a high-gain antenna, belonging to the millimeter-wave transmitter, mounted on an elevated structure that vibrates mechanically such that said vibration causes said high-gain antenna to point to a direction which varies up and down by no more than a total of X degrees; said high-gain antenna operative to generate a radiation pattern having a horizontal beam-width that is less than X degrees and a vertical beam-width that is substantially X degrees;

wherein said horizontal beam-width is operative to provide said high-gain antenna with high gain, and said vertical beam-width is operative to allow the millimeter-wave transmitter to maintain stable communication with the millimeter-wave receiver, via said high-gain antenna and using millimeter-waves, despite said vibration.

2. The system of claim 1, wherein during said vibration, the millimeter-wave receiver does not go outside coverage of said high-gain antenna, thereby facilitating said stable communication.

3. The system of claim 1, wherein said vertical beam-width is operative to compensate for said vibration.

4. The system of claim 1, wherein said vibration is caused by wind.

5. The system of claim 4, wherein said wind causes an upper portion of the elevated structure to move back and forth, away and toward the millimeter-wave receiver respectively, while a lower portion of said elevated structure is held fix by ground, thereby causing said high-gain antenna to point to a direction which varies up and down.

6. The system of claim 5, wherein said vibration is the elevated structure resonating with said wind.

7. The system of claim 1, wherein said vibration is caused by a mechanically vibrating device located on or nearby said elevated structure.

8. The system of claim 1, wherein said vibration is a movement of said elevated structure.

9. The system of claim 8, wherein said movement is caused, over time, by mechanical stresses exerted on said elevated structure.

10. The system of claim 8, wherein said movement is caused by a change of load placed on the elevated structure.

11. The system of claim 1, wherein said elevated structure is a pole.

12. The system of claim 1, wherein said elevated structure in a communication tower.

13. The system of claim 1, wherein said horizontal beam-width is between 2 and 4 degrees and said vertical beam-width is between 6 and 10 degrees, thereby X is between 6 and 10 degrees respectively.

14. The system of claim 13, wherein the high-gain of said high-gain antenna is between 30 dBi and 35 dBi.

15. The system of claim 13, wherein the operating frequency of said high-gain antenna is between 50 GHz and 80 Ghz.

16. The system of claim 1, wherein said horizontal beam-width is between 1 and 6 degrees and said vertical beam-width is between 7 and 12 degrees.

17. The system of claim 1, wherein said high-gain antenna is a reflector antenna, and a horizontal size of said reflector antenna is bigger than a vertical size of said reflector antenna, thereby facilitating generation of said radiation pattern having a horizontal beam-width that is less than X degrees and a vertical beam-width that is substantially X degrees.

18. The system of claim 1, wherein said high-gain antenna is a shaped parabolic antenna, having a vertical shape operative to de-focuses said radiation pattern in the vertical direction, thereby facilitating generation of said radiation pattern having a horizontal beam-width that is less than X degrees and a vertical beam-width that is substantially X degrees.

19. The system of claim 1, wherein said high-gain antenna is an array of patches or slots.

20. The system of claim 19, wherein there are more patches or slots in a horizontal direction of said array, than there are patches or slots in a vertical direction of said array, thereby facilitating generation of said radiation pattern having a horizontal beam-width that is less than X degrees and a vertical beam-width that is substantially X degrees.

21. The system of claim 1, wherein said radiation pattern having a horizontal beam-width that is less than one-half X degrees and a vertical beam-width that is substantially X degrees.

22. The system of claim 21, wherein the high-gain of said high-gain antenna is higher than 20 dBi, and the operating frequency of said high-gain antenna in between 30 GHz and 80 GHz.

23. The system of claim 21, wherein the high-gain of said high-gain antenna is higher than 30 dBi, and the operating frequency of said high-gain antenna in between 30 GHz and 80 GHz.

24. The system of claim 1, wherein said radiation pattern having a horizontal beam-width that is less than one-quarter X degrees and a vertical beam-width that is substantially X degrees.

25. The system of claim 24, wherein the high-gain of said high-gain antenna is higher than 25 dBi, and the operating frequency of said high-gain antenna in between 30 GHz and 80 GHz.

26. The system of claim 24, wherein the high-gain of said high-gain antenna is higher than 35 dBi, and the operating frequency of said high-gain antenna in between 30 GHz and 80 GHz.

27. The system of claim 1, wherein said vibration causes said high-gain antenna to point to a direction which varies up and down by an amount of between X degrees and one-half X degrees.

28. The system of claim 1, wherein said vibration causes said high-gain antenna to point to a direction which varies up and down by an amount of between X degrees and one-quarter X degrees.

* * * * *